United States Patent [19]

Bauman et al.

[11] 4,344,246

[45] Aug. 17, 1982

[54] FIRING PIN BLOCK FOR FIREARM HAVING A RECIPROCATING BREECH BOLT

[75] Inventors: Thomas G. Bauman; Jack L. Kast, both of Ilion, N.Y.

[73] Assignee: Remington Arms Company, Inc., Bridgeport, Conn.

[21] Appl. No.: 121,436

[22] Filed: Feb. 14, 1980

[51] Int. Cl.[3] ..... F41C 11/02

[52] U.S. Cl. ..... 42/69 B; 89/190

[58] Field of Search ..... 42/16, 18, 20, 69 B; 89/168, 176, 190

[56] References Cited

U.S. PATENT DOCUMENTS 2,418,946 4/1947 Loomis ..... 42/16

2,601,808 7/1952 Clarke ..... 89/190

FOREIGN PATENT DOCUMENTS 487781 12/1953 Italy ..... 89/190

*Primary Examiner*—Stephen C. Bentley

*Attorney, Agent, or Firm*—Nicholas Skovran; William L. Ericson; Barry Estrin

[57] ABSTRACT

A firing pin block for a firearm of the type having a reciprocating bolt assembly including a breech bolt and slide block, a firing pin, and a pivotal locking block. The slide block and locking block have cam means which cooperate to pivot the locking block in and out of locking engagement with a recess in the barrel as the slide block is reciprocated to close and open the bolt. The operation of these cam means is coordinated with relative longitudinal displacements between the bolt and slide block so that, at any time the locking block is not completely locked, the slide block prevents sufficient forward movement of an abutment on the firing pin to cause the firearm to discharge. This firing pin block is effective even though the firing pin spring and retaining pin may be broken, distorted, or missing.

8 Claims, 10 Drawing Figures

FIRING PIN BLOCK FOR FIREARM HAVING A RECIPROCATING BREECH BOLT

FIELD OF THE INVENTION

This invention relates to a firing pin block that prevents a firearm having a reciprocating breech bolt from being discharged with its bolt in an unlocked position. More particularly, it relates to a firing pin block for a firearm of the type in which a reciprocating breech bolt assembly includes a locking block that is movable between a position locked to the barrel and an unlocked position, this movement being imparted by cam means drivingly connecting the locking block with a reciprocating slide block which serves to open and close the bolt.

BACKGROUND AND PRIOR ART

The idea of blocking a firing pin to prevent the discharge of a reciprocating-bolt firearm when the bolt is in an unlocked position is not new. U.S. Pat. No. 2,645,873 to L. R. Crittendon shows a slide-actuated firearm which has a reciprocating bolt that is locked to the barrel by a tilting locking block, as the bolt is closed by forward movement of a slide block. The locking block has buttresses at its rear end, which, in its unlocked, downwardly-tilted position, block an enlarged head on the firing pin to prevent the firing pin from protruding from the bolt face. The blockage is removed as the locking block is tilted upwardly into engagement with a locking recess in a barrel extension.

This device is satisfactory except in cases where the firing pin is bent enough to jam in the bolt in its forward position protruding from the bolt face; or where the firing pin spring is broken. In these circumstances, the firing pin is not withdrawn by the firing pin spring and the buttresses on the locking block are cramped down against the enlarged head of the firing pin as the opening movement of the bolt tilts the locking block down from its locked position. This may jam the mechanism, or actually break the firing pin. Another potential difficulty is that since the tilting motion of the block and its buttresses is necessarily very short, the blocking and retracting action depends on the maintenance of close tolerances, and may be adversely affected by wear or distortion of the parts.

Another type of firing pin block, applicable to a recoiling-barrel actuated reciprocating-bolt action, is shown in U.S. Pat. No. 2,570,772 to L. R. Crittendon. Here, a tilting locking block is pivotally connected to the slide block, and is urged forwardly by an action spring against a bolt surface, which normally wedges the locking block upwardly into locking engagement with a recess in the barrel extension. When the barrel moves rearwardly from its battery position after firing, however, it cams the locking block down out of the recess. This wedges the locking block against the bolt surface so as to displace the bolt slightly forward relative to the slide block, to a position in which any forward movement of the firing pin is blocked by the slide block before the firing pin can protrude from the bolt face. This blockage is maintained until the barrel is moved forward to battery position and the locking block is re-engaged in the barrel extension recess.

BRIEF DESCRIPTION OF THE INVENTION

It is the general object of the present invention to provide an improved 100% firing pin block for a reciprocating-bolt firearm, which requires only the cooperation of a bolt, slide block, locking block, and firing pin to positively prevent the firing pin from protruding from the bolt face whenever the locking block is not in a fully-locked position to secure the bolt safely in battery position.

Although the firing pin block of the present invention can serve as the sole means to prevent firing of a reciprocating bolt firearm when the bolt is not fully locked, it is preferred to use the system as a fail-safe device, in conjunction with other, conventional means for preventing firing when the bolt is open. For example, the assignee of the present invention has for some years made firearms having a trigger disconnector (which may be integrated with an action bar lock in slide-action models) to prevent firing when the breech bolt is open. Examples of these devices are shown in U.S. Pat. Nos. 2,645,873 and 2,675,638 to L. R. Crittendon.

The present firing pin block incorporates an enlarged abutment formed rearwardly on the firing pin, which is engageable with a rearward portion of a slide block to prevent movement of the firing pin into a position protruding from the bolt face until the bolt is fully locked up by pivotal movement of a locking block into full engagement in a mating recess in the barrel or barrel extension. This blockage of the firing pin is achieved by coordination of relative longitudinal displacements of the slide block and bolt with the operation of cam means, which drivingly connect the slide block with the locking block to produce pivotal locking motion of the latter element as the bolt closes on the barrel breech and the slide block continues to move forwardly.

DETAILED DESCRIPTION

The present invention is equally applicable to manual slide-operated firearms and gas-operated semiautomatic firearms of the type having a reciprocating bolt. Since the fire control system and the reloading system of the firearm are not directly concerned with the firing pin block of this invention, and may be of various designs well known in the art, these systems have been omitted from the drawings. Reference is made to Crittendon U.S. Pat. No. 2,645,873 for a typical example of a slide-operated firearm to which the present invention might be applied.

Figure 1:
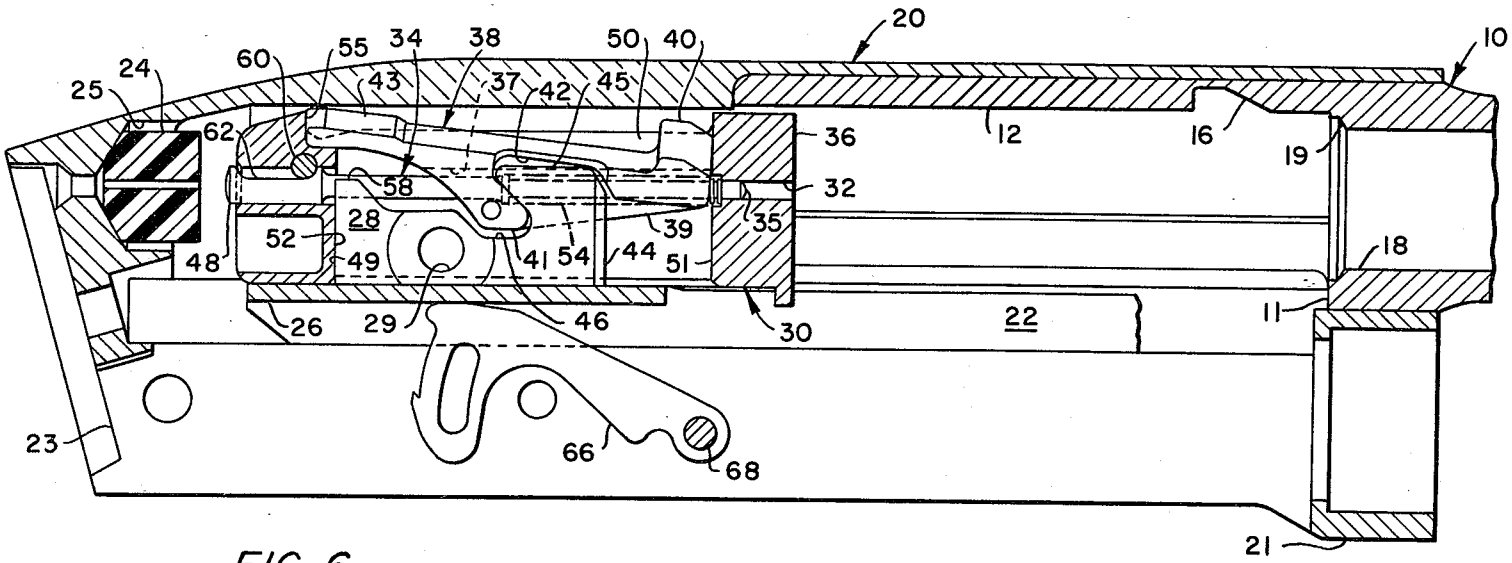
FIG. 1 is a sectional view in side elevation of a preferred embodiment of the invention, showing a bolt assembly, including a firing pin, bolt, slide block, and locking block, at the rear end of its stroke, and the breech open.

FIG. 1 shows a firearm including a barrel 10 having an integral extension 12 formed with a locking recess 16. The barrel is formed with a cartridge-receiving chamber 18 terminating rearwardly in a circumferential counterbore 19 for seating the head of the cartridge, and a surface 11 defining a rearwardly-facing open breech. The barrel is affixed in a receiver 20, which has a socket 23 at its rear end for mounting a shoulder stock (not shown), and a ring 21 at its forward end for mounting a conventional cartridge magazine tube (not shown).

An action bar assembly 22 is reciprocably slidable longitudinally of the receiver, and extends forwardly for attachment to conventional manual or gas operating means (not shown) located at the fore-end of the firearm. The assembly 22 comprises a pair of parallel action bars interconnected at their rear ends by a transverse web 26, to which a slide block 28 is affixed. The slide block has an opening 29 for mounting a manual bolt-operating handle (not shown).

A breech bolt 30 has a recess 50 extending vertically therethrough, and the slide block 28 is received in this recess for limited longitudinal movement relative to the bolt. The limits of this movement are defined by the engagement of a rear surface 49 of the slide block with a forwardly-facing interior surface 52 in the bolt recess, in a rearward relative position of the slide block shown in FIG. 1; and by the engagement of a front surface 44 of the slide block with a rearwardly-facing interior surface 51 in the bolt recess, in a forward relative position of the slide block shown in FIG. 9.

Figure 9:
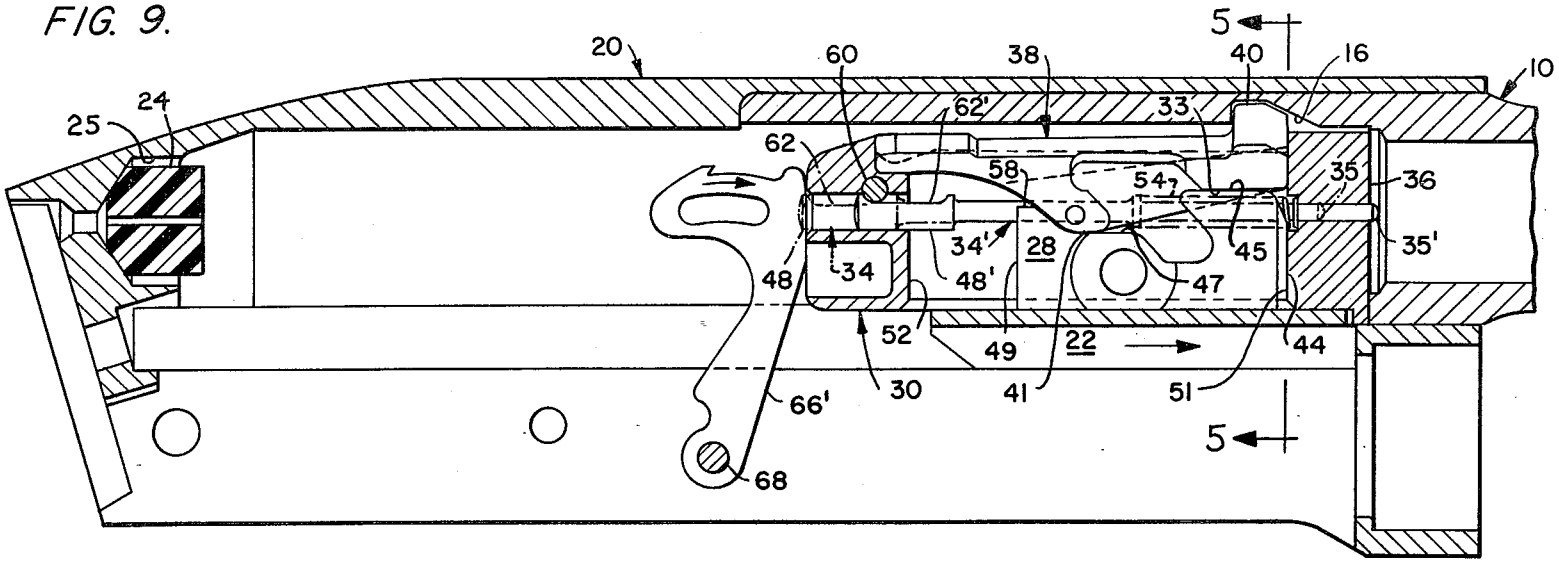
FIG. 9 is a view similar to FIG. 8, but showing the completion of the forward stroke of the slide block, with the parts in their normal firing positions, and the hammer shown striking the firing pin.

The bolt 30 has an axial bore 32, in which a firing pin 34 is reciprocably slidable between a retracted position shown in FIG. 1, in which its tip 35 is withdrawn behind the bolt face 36, and an extended position in which the tip protrudes forwardly from the bolt face, as shown at 35' in FIG. 9, to fire a cartridge (not shown) received in the chamber 18. The firing pin is biased rearwardly by a compression spring 54 bearing against the bolt surface 51 and receiving the firing pin coaxially therethrough. The firing pin is retained by a transverse pin 60 extending transversely of the bolt through the bore 32, and cooperating with a flat 62 milled in the firing pin to limit movement of the firing pin with respect to the bolt. The firing pin has an enlarged head or abutment 48 formed in its rear end, which protrudes rearwardly from the bolt in the retracted position of the firing pin.

Figure 2:
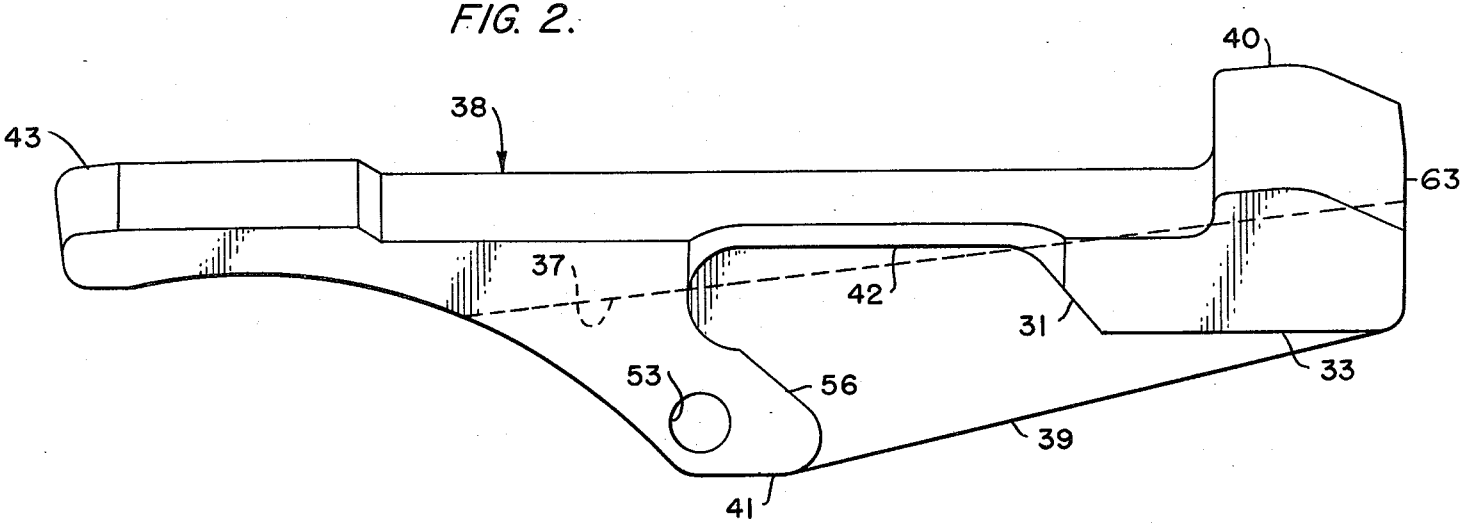
FIG. 2 is an enlarged view in side elevation of the locking block of FIG. 1.
Figure 3:
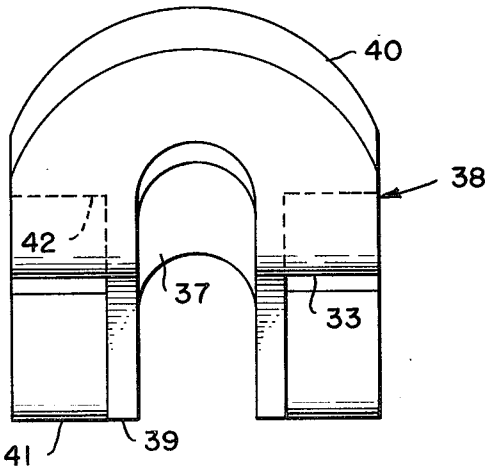
FIG. 3 is an enlarged view in front elevation of the locking block.
Figure 4:
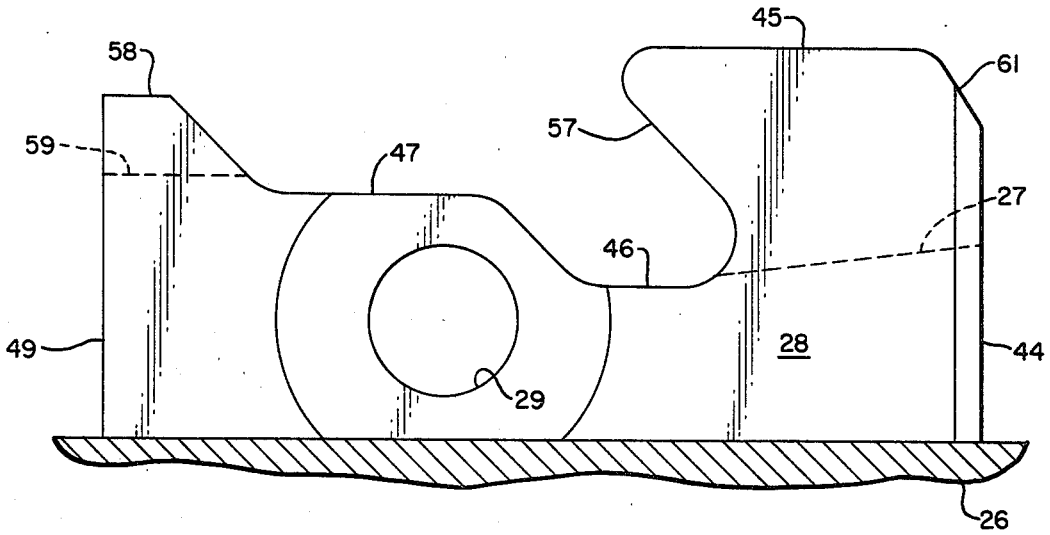
FIG. 4 is an enlarged view in side elevation of the slide block of FIG. 1.
Figure 5:
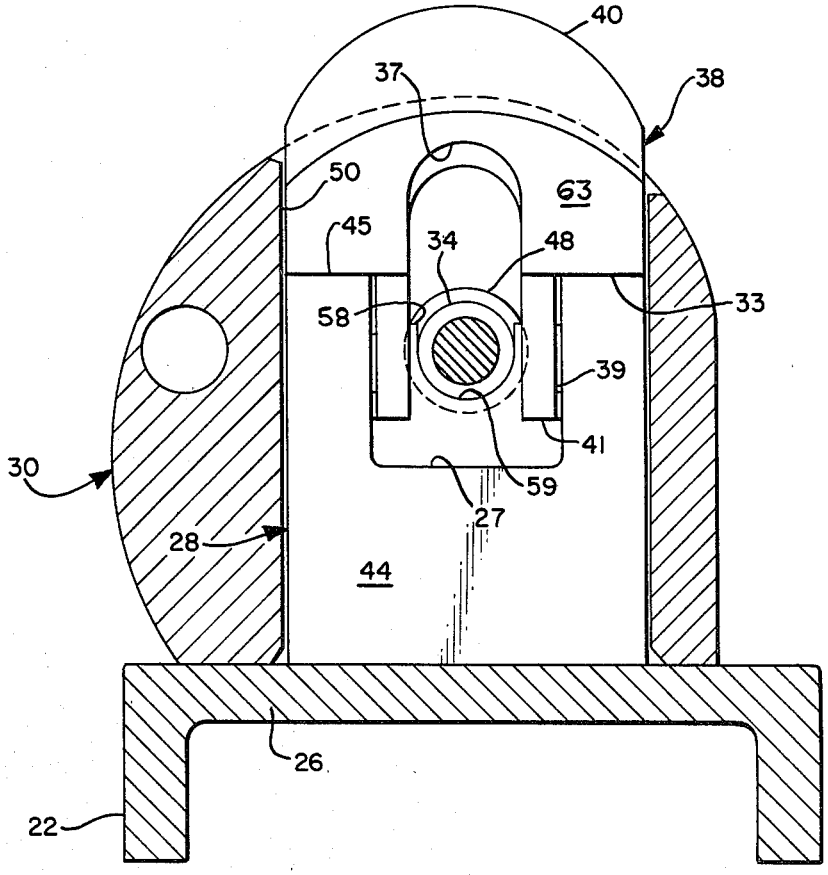
FIG. 5 is an enlarged sectional view in front elevation of the bolt assembly of FIG. 1, taken along line 5—5 in FIG. 9, looking in the direction of the arrows.

A locking block 38, which is also shown on an enlarged scale in FIGS. 2, 3, and 5, is received in the bolt recess 50 above the slide block 28. The locking block has an arm 43 which is received in a recess 55 at the rear of the bolt, and on which the locking block is free to pivot between a lowered position shown in FIG. 1, and a locked position shown in FIGS. 7–9, in which a lug 40 formed on the locking block engages in the barrel recess 16. The locking block is formed in an inverted U-shape, having a sloping central channel 37 to provide clearance for the firing pin 34 in both the lowered and the locked positions, and a pair of depending parallel web portions 39. These web portions straddle the firing pin and fit into a recess 27 lying between a pair of upstanding cam lugs 45 on the slide block 28, as shown in FIGS. 4 and 5.

The locking block 38 has flat surfaces 33 at its forward end, which rest on top of the flat upper surfaces of the lugs 45 in the locked position shown in FIGS. 5 and 9. Central recesses 42 are formed on either side of the web portions 39, for receiving the lugs 45 in the lowered position of the locking block shown in FIG. 1. Sloping cam surfaces 31 connect the recesses 42 with the flats 33. A pair of depending legs 41 provide further sloping cam surfaces 56 at the rear of the recesses 42. One of these legs is formed with a blind hole 53 (see FIG. 2) in which a pin (not shown) may be secured to prevent accidental disassembly of the locking block when the bolt assembly is removed from the receiver for cleaning.

The lugs 45 of the slide block 28, which is shown on an enlarged scale in FIGS. 4 and 5, are formed with sloping cam surfaces 61 joining the front surface 44 with their flat upper surfaces; and with further sloping cam surfaces 57 extending down into a recess 46, which receives the locking block legs 41 in the lowered position of FIG. 1. The upper surface of the slide block is relieved at 47 to permit it to move under the locking block 38 into its forward position shown in FIG. 9.

At its rear end adjacent to the surface 49, the slide block 28 is provided with a raised rearward portion 58, which is aligned with the firing pin abutment 48 in the direction of longitudinal reciprocation of the bolt assembly and firing pin. A U-shaped recess 59 extends longitudinally through the portion 58, and is sized to receive the body of the firing pin 34 in freely-slidable relation, but to block movement of the abutment 48 forwardly of the surface 49.

A hammer 66 is pivotally mounted on a pin 68 secured in the receiver 20, and is rotatable clockwise, when released by a suitable trigger and fire control mechanism (not shown) from a cocked position shown in FIG. 1 to a firing position shown in FIG. 9, in which it impacts the rear end of the firing pin abutment 48 to discharge the firearm. To cushion the shock of recoil of the bolt assembly against the receiver when it is driven rearwardly after firing, an elastomeric plug 24 is secured in a recess 25 at the rear of the receiver.

CYCLE OF OPERATION

Figure 6:
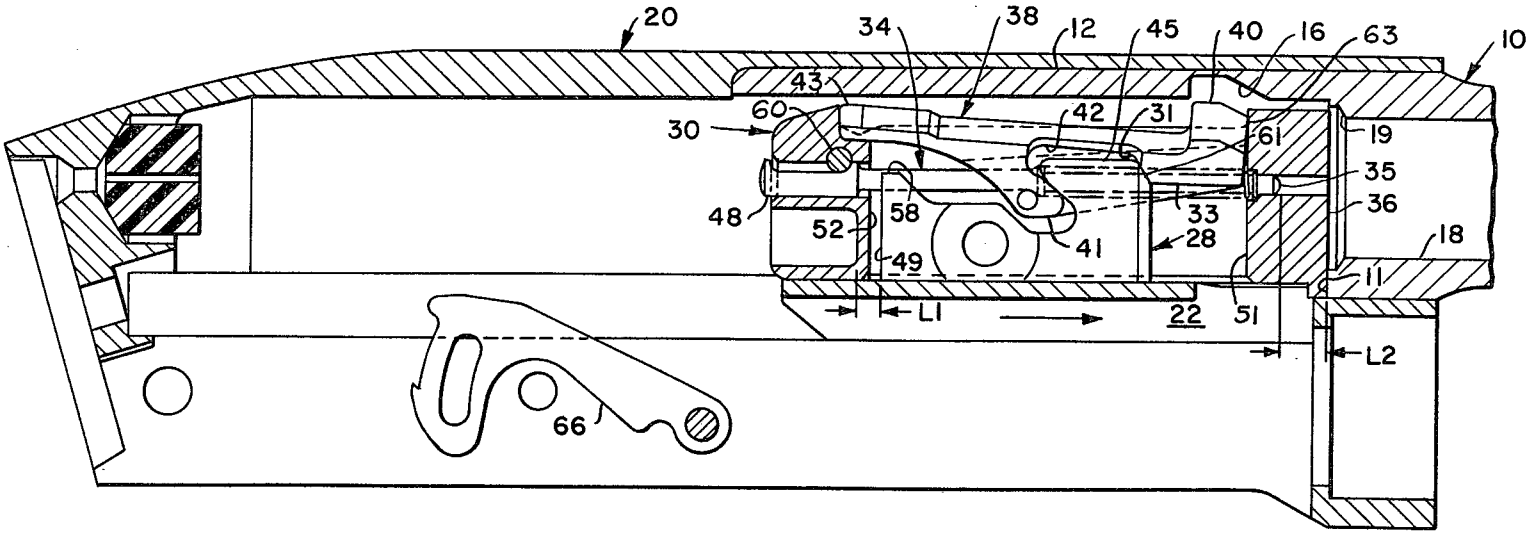
FIG. 6 is a view similar to FIG. 1, but showing the slide block approaching the forward end of its stroke, with the bolt abutting the breech end of the barrel, and the locking block retracted from locking engagement with the barrel.

The action bars 22 and slide block 28 are shown moving forward in FIG. 6, in the direction shown by the arrow. The slide block first moves independently of the bolt 30, separating the surfaces 49 and 52; however, the cam surface 61 of the slide block shortly engages the cam surface 31 of the locking block 38, and commences to drive the locking block forwardly. Any tendency to tilt the locking block upwardly at this time is resisted frictionally by the resulting pressure of the forward locking block surface 63 against the interior bolt surface 51; but if this resistance is overcome, the lug 40 will simply slide against the interior of the receiver 20 and barrel extension 12, until the lug reaches the recess 16. The bolt 30 is driven forwardly with the locking block until its face 36 seats against the barrel breech surface 11, as shown in FIG. 6.

Throughout the bolt-closing movement, the slide block surface 49 is separated slightly from the bolt surface 52. The dimensions of the firing pin are such that in its retracted position shown in FIG. 6, its tip 35 lies a distance L2 behind the bolt face 36; while the forward end of the abutment 48 lies a smaller distance L1 behind the slide block surface 49 at the portion 58. The hammer 66 is normally held in the illustrated cocked position by the fire-control mechanism during the closing movement. However, if it should be accidentally released at this time, it cannot drive the firing pin farther than the distance L1, too short a movement to cause the tip 35 to protrude from the bolt face to discharge the firearm. Nor can the firing pin move forward under its own inertia, if the firearm is accidentally dropped, enough to cause a discharge. This will be the case even if the spring 54 and retaining pin 60 are bent, broken, or missing altogether.

As the forward movement of the action bars 22 and slide block 28 continues, the arrest of the bolt 30 against the barrel breech also arrests forward movement of the locking block 38. The cam surfaces 31 and 61 then cooperate to tilt the locking block as shown by the arrow in FIG. 7, engaging the lug 40 in the recess 16 to lock the bolt to the barrel. The longitudinal component of the relative sliding motion of the cam surfaces 31 and 61 necessary to complete this locking action, plus a sufficient additional motion to insure that the flat surfaces 33 are securely supported on top of the lugs 45, is shown at L3.

The dimensions of these cam surfaces are, in the preferred embodiment, coordinated with the dimensions of the remaining parts of the bolt assembly so that the sum of the initial forward displacement L1 of the slide block 28 with respect to the forward end of the firing pin abutment 48, as shown in FIG. 6, plus the additional forward displacement L3, is substantially equal to the distance L2 between the retracted firing pin tip 35 and the bolt face 36. The result is that at the stage of FIG. 7, when the bolt is in battery position and the locking block is fully engaged, the gap between the firing pin abutment 48 and the surface 49 at the slide block portion 58, is also equal to L1. Consequently, the firing pin continues to be blocked against protruding from the bolt face, as its maximum forward movement will carry the tip 35 only to a point flush with the bolt face 36.

Figure 8:
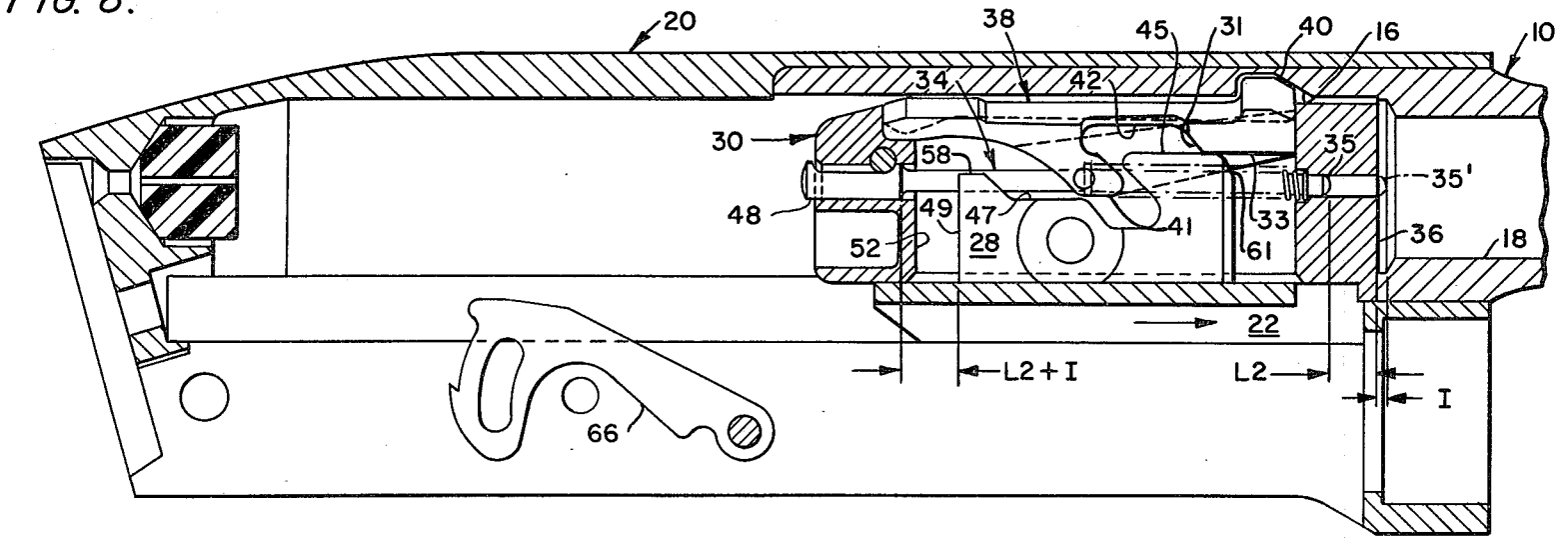
FIG. 8 is a view similar to FIG. 7, but showing the slide block moved still farther forward, to the first position in which firing becomes possible.

FIG. 8 shows the continuation of forward movement of the slide block 28 through an additional distance I, which will permit the firing pin abutment to be driven forwardly a maximum total distance L2 plus I. At this point, the tip 35 can be made to protrude from the bolt face to indent and ignite the primer of a cartridge (not shown) seated in the chamber 18. The maximum primer indent distance is I.

Figure 7:
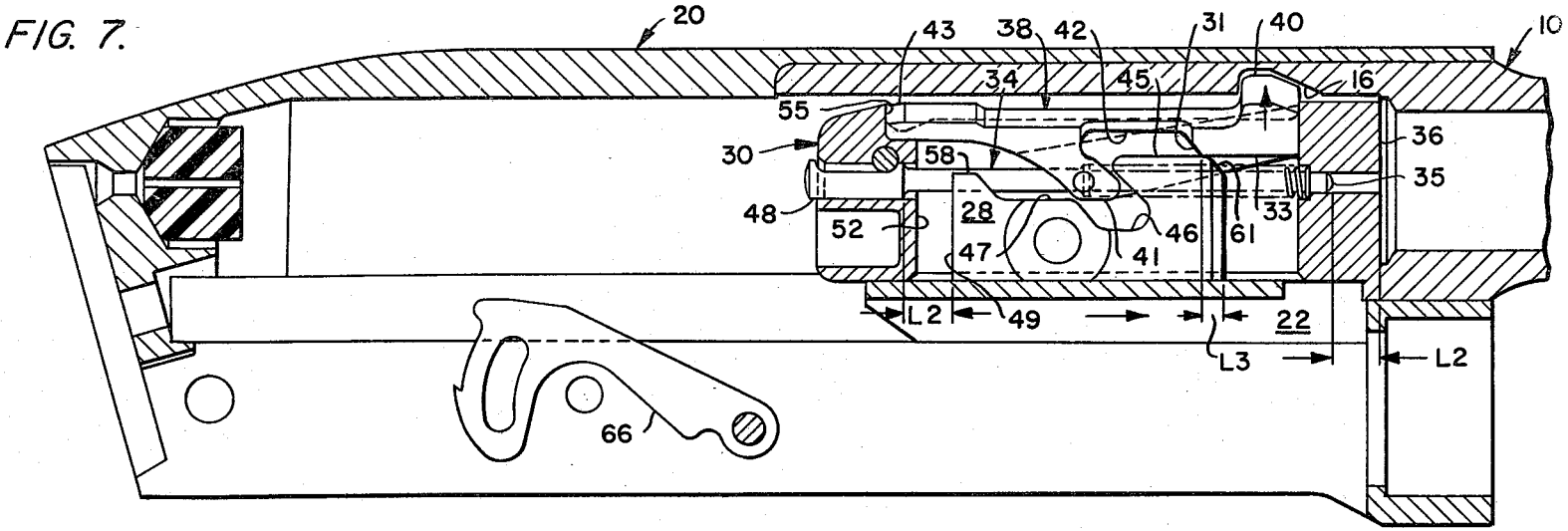
FIG. 7 is a view similar to FIG. 6, but showing the slide block moved farther forward relative to the bolt, enough to cause angular movement of the locking block into locking engagement with the barrel, but not yet far enough to permit firing to occur.

It will be observed that even though the bolt reaches a fully-locked condition at the stage of FIG. 7, further forward travel of the slide block 28 toward the position of FIG. 8 is required before the firearm can be discharged. This provides an additional margin of safety to cover the possibility that the parts might become distorted or badly worn.

The continuing movement of the slide block 28 from the position of FIG. 7 to that of FIG. 8, and on to its forward position of FIG. 9 abutting the interior bolt surface 51, represents lost motion relative to the bolt 30. This is accommodated by sliding movement of the upper flat surfaces of the lugs 45 under the flat surfaces 33 of the locking block 38, and by movement of the legs 41 into the relieved section 47.

Normal firing of the firearm is illustrated in FIG. 9 by rotation of the hammer 66 to strike the abutment 48 and come to rest at a position 66' against the rear surface of the bolt 30. The momentum imparted to the firing pin 34 compresses the spring 54 and drives the firing pin forwardly to a position 34', in which it is arrested by the retaining pin 60 engaging the flat at 62', and its tip projects from the bolt face at 35' to discharge the firearm.

Figure 10:
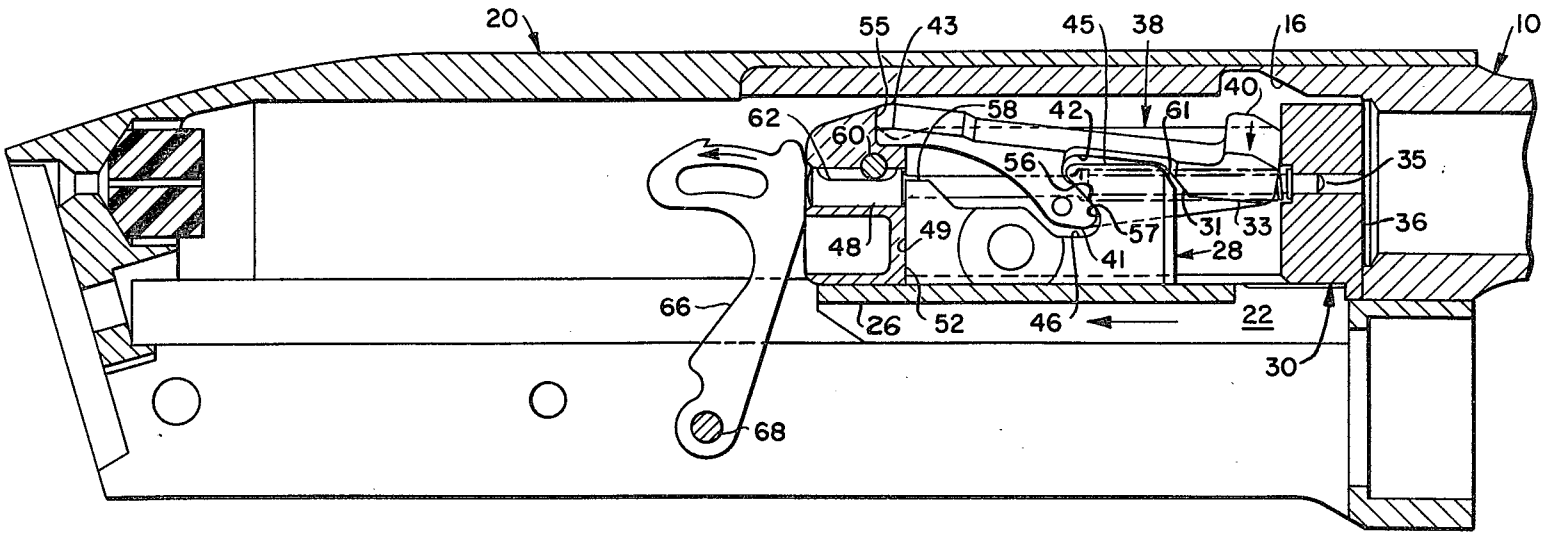
FIG. 10 is a view similar to FIG. 9, but showing the commencement of rearward movement of the slide block after firing, and the unlocking of the bolt.

FIG. 10 illustrates the initiation of reverse movement of the bolt assembly to reopen the breech and recock the hammer after firing. The action bars 22 are driven to the rear, as shown by the arrow, by either manual or gas operation as the case may be. This initially retracts only the slide block 28, as the upper surfaces of the lugs 45 slide freely under the locking block surfaces 33. When the slide block has retreated to the position of FIG. 8, its rearward portion 58 engages the abutment 48 and forcibly retracts the firing pin 34.

Shortly thereafter, at a time when the pressure in the barrel 10 has dropped to a safe level, the cam surfaces 61 and 31 slide together and disengage, the lugs 45 enter the recesses 42, and the cam surfaces 56 and 57 engage and force the locking block 38 to tilt downwardly, as shown by the arrow in FIG. 10, to withdraw the lug 40 from the recess 16 and thereby unlock the bolt 30.

At this stage, the slide block reaches its rearward relative position with respect to the bolt, with the surfaces 49 and 52 abutting, and the continuing retraction of the slide block is thereafter imparted to the bolt and locking block as well. The opening movement of the bolt causes it to push the hammer counterclockwise, and recocking is completed by subsequent rearward movement of the action bar web 26 over the hammer to the position of FIG. 1, when the hammer is held cocked by the aforementioned fire control.

VARIATION OF DIMENSIONAL RELATIONSHIPS

In the preferred embodiment which has been illustrated and described, the rear surface 49 of the slide block portion 58 is positioned even closer to the firing pin abutment 48 than is necessary to ensure that the locking block lug 40 must be fully engaged in the barrel recess 16 before the firing pin tip 35 can be made to protrude from the bolt face 36 to discharge the weapon. This provides a margin of extra safety in the event that the parts, particularly the abutment 48, the slide block portion 58, and the cam surfaces 31 and 61, might become worn or distorted.

The dimensional relationships involved in this delay in removal of the firing pin block are illustrated in FIGS. 7 and 8. The parts are so dimensioned that at the stage of completing the upward movement of the lug 40 into the locking recess shown in FIG. 7, when the cam surface 61 has finished its sliding motion over the cam surface 31 and the locking block surface 33 rests on the lugs 45, the rearward portion 58 of the slide block 28 is spaced ahead of the abutment 48 only the same distance L2 that the firing pin tip 35 lies behind the bolt face 36.

It will be seen by comparing FIGS. 7 and 8, that if the slide block 28 was to be shortened so that the portion 58 was spaced ahead of the abutment 48 a distance in the range between L2 and L2+I, at the stage of operation shown in FIG. 7, rather than at the more advanced stage of FIG. 8, full bolt lock-up would still have to be achieved before firing could take place. Such a variation is considered to fall within the scope of invention in its broader aspects, although it is not preferred because of the reduced degree of safety it would provide in a firearm that is designed to serve a useful life of indefinite length, and whose parts might become worn or distorted after long use.

What we claim is:

1. A firearm including a receiver; a barrel secured to said receiver, and having a rearwardly-open breech; said firearm being formed with a locking recess;

a breech bolt reciprocable longitudinally in said receiver, and having a front face adapted to close said breech;

a locking block received in said bolt for longitudinal reciprocation therewith, said locking block being arranged for pivotal movement, transverse to the longitudinal reciprocation of said bolt, to and from a locked position engaged in said recess to lock said bolt to said firearm;

a firing pin received in said bolt for longitudinal sliding motion between a position retracted behind said bolt face and a position protruding forwardly therefrom, and having an enlarged abutment formed rearwardly thereon;

and a unitary slide block movable forwardly and rearwardly in said receiver; a rearward portion of said slide block being aligned with said abutment in the direction of longitudinal motion of said firing pin; said bolt being movable forwardly to close and arrest said bolt face against said breech by forward movement of said slide block into a first position, and movable rearwardly to open said breech by rearward movement of said slide block;

said slide block and said locking block being formed with mutually-engageable cam surfaces constructed and arranged for pivoting said locking block into full engagement with said recess in response to movement of said slide block relative to said bolt into a second position advanced forwardly from said first position, and for retracting said locking block from said recess in response to retracting movement of said slide block into said first position;

said rearward portion of said slide block extending rearwardly toward said abutment to a length effective, in said second position of said slide and all positions rearward thereof, to block any forward movement of said abutment sufficient to cause said firing pin to protrude forwardly of said bolt face.

2. A firearm as recited in claim 1, said firing pin having a tip which, in said retracted position thereof, lies a distance L2 behind said bolt face; said rearward portion of said slide block, in said second position thereof, being spaced ahead of said firing pin abutment a distance no greater than said distance L2, whereby said firing pin may not be driven forwardly far enough to cause said tip to protrude from said bolt face.

3. A firearm as recited in claim 2, said slide block being movable forwardly from said second position to space said rearward portion of said slide block ahead of said firing pin abutment a distance greater than said distance L2, such that said firing pin may be driven forwardly to cause said tip thereof to protrude from said bolt face.

4. A firearm as recited in claim 2, said rearward portion of said slide block, in said first position thereof, being spaced ahead of said firing pin abutment a distance L1; said second position of said slide block lying ahead of said first position thereof a distance L3, determined by the construction and arrangement of said cam surfaces; the sum of said distances L1 and L3 being no greater than said distance L2.

5. A firearm as recited in claim 4, the sum of said distances L1 and L3 being substantially equal to said distance L2.

6. A firearm as recited in claim 4, said slide block being movable forwardly from said second position to space said rearward portion of said slide block ahead of said firing pin abutment a distance at least equal to said distance L2 plus a primer indent distance I, such that said firing pin may be driven forwardly to cause said tip thereof to protrude from said bolt face at least said primer indent distance I.

7. A firearm having a receiver and a barrel affixed to said receiver, said barrel having an open breech; said firearm being formed with a locking recess;

a breech bolt mounted in said receiver for reciprocating longitudinal movement, said bolt having a front face adapted to close said breech;

a locking block received in said bolt for longitudinal reciprocation therewith, said locking block being arranged for pivotal movement to and from a locked position engaged in said recess to lock said bolt to said firearm;

a firing pin received in said bolt for longitudinal movement between a position retracted behind said bolt face and a position protruding forwardly therefrom, said firing pin having an enlarged abutment formed rearwardly thereon;

and a unitary slide block mounted in said receiver for longitudinal movement therein, and arranged for limited relative longitudinal movement between rearward and forward positions with respect to said bolt;

said slide block and said locking block having mutually-engageble cam surfaces operable, in response to a first stage of a movement of said slide block from said rearward position toward said forward position thereof, to move said bolt forwardly to close said bolt face against said breech, and operable, in response to a second stage of said movement of said slide block toward said forward position, to pivot said locking block into full engagement with said recess;

said slide block having a rearward portion constructed and arranged to block forward movement of said abutment sufficient to extend said firing pin beyond said bolt face into said forwardly-protruding position until at least said first and second stages of forward movement of said slide block are fully completed;

a third stage of movement of said slide block toward said forward position thereof being effective to enable forward movement of said abutment sufficient to cause said firing pin to reach said protruding position.

8. A firearm as recited in claim 7, said firing pin having a tip which, in said retracted position thereof, lies a distance L2 behind said bolt face; said rearward portion of said slide block being spaced ahead of said abutment a distance no greater than said distance L2 at the conclusion of said second stage of movement of said slide block, whereby said firing pin is blocked from reaching said forwardly-protruding position until said slide block enters said third stage of movement toward said forward position.

* * * * *